United States Patent [19]

Keddie et al.

[11] Patent Number: 4,513,466

[45] Date of Patent: Apr. 30, 1985

[54] WATER-POWERED BRUSH

[75] Inventors: David P. Keddie; Richard J. Shaw, both of Brookfield, Wis.

[73] Assignee: Hempe Manufacturing Co., New Berlin, Wis.

[21] Appl. No.: 653,365

[22] Filed: Sep. 24, 1984

[51] Int. Cl.[3] ..... A46B 13/06

[52] U.S. Cl. ..... 15/29

[58] Field of Search ..... 15/28, 29, 97 R; 128/56

[56] References Cited

U.S. PATENT DOCUMENTS

| | | | |
|---|---|---|---|
| 2,540,240 | 2/1951 | Boyle | 15/29 |
| 2,678,457 | 5/1954 | Demo et al. | 15/29 |
| 4,089,079 | 5/1978 | Nicholson | 15/29 |
| 4,327,454 | 5/1982 | Spence | 15/29 |
| 4,370,771 | 2/1983 | Gonzalvo | 15/29 |

*Primary Examiner*—Edward L. Roberts

*Attorney, Agent, or Firm*—Fuller, House & Hohenfeldt

[57] ABSTRACT

A plastic housing shell has two spaced apart bosses in it and first and second shafts extend in parallelism from the bosses. A turbine rotor has a bore that fits loosely over the first shaft and has a concentric first pinion with the same oversized bore. A gear and an integral pinion are journaled on the second shaft. The gear meshes with the pinion on the turbine rotor and the pinion on the gear meshes with a gear on a base ring of a rotary brush. The gear on the brush ring has a bored cylindrical shaft extending axially from it which slips over the first shaft for the brush to rotate on it while the periphery of the cylindrical shaft fits into the bore of the pinion and rotor so the rotor is journaled on said cylindrical shaft. Springy latch prongs engage a cover through which the brush extends so said cover retains all of the brush assembly parts in assembled condition. No other fasteners are required. A conduit that supplies the water jet for driving the turbine serves as a handle for the brush.

5 Claims, 6 Drawing Figures

WATER-POWERED BRUSH

RELATED APPLICATION

The article shown herein is the subject of a design patent application, Ser. No. 644.577, filed Aug. 27, 1984.

BACKGROUND OF THE INVENTION

This invention relates to a brush that is driven rotationally by a water turbine and can be held in the hand of the user for washing automobiles and other objects.

There are a large number of prior art water-powered brushes such as are described in U.S. Pat. Nos. 2,540,240 to Boyle; 2,678,457 to Demo; 4,089,079 to Nicholson; 4,327,454 to Spence; and 4,370,771 to Gonzalvo. The brushes described in these patents are perceived to be structurally complex and difficult to assemble such that they are considered by the present inventors to be uneconomical to produce and, hence, incapable of being sold at an attractive price. Moreover, it is evident from the prior art designs that assembly of the brushes would be time consuming and costly because of the number of manual operations that must be performed to produce a completed brush.

SUMMARY OF THE INVENTION

Briefly stated, the new water-powered brush is comprised of a molded plastic housing, like a shell, which has a bottom opening. There are two bosses molded in the top wall of the housing and a shaft extends from each of them. The bosses provide a shoulder around the shafts. A turbine rotor having a coaxial pinion fits over the first shaft with substantial clearance. The tips of the turbine blades extend radially to a barrier wall, constituting a segment of a circle, but there is sufficient clearance between the blade tips and wall to permit free rotation of the wheel. A conduit for pressurized water leads to the barrier wall in which there is an orifice for projecting a jet of water against the turbine blades to effect high speed rotation. A large gear is journaled on the second shaft and it meshes with the coaxial pinion on the turbine rotor. Said gear has a coaxial pinion integral with it and the pinion and gear have a common bore which allows the gear to rotate directly on the second shaft. The gear meshes with the pinion on the rotor. The pinion on said gear meshes with a gear on a rotary brush so that the brush is driven at a reduced speed compared with the rotor. The brush has a circular base plate with bristles on one side and an axially bored cylindrical shaft extending axially from its other side. The diameter of the bore is complementary to the first shaft on which the rotor fits loosely. The outside diameter of the cylindrical shaft fits into the complementarily sized bore of the pinion on the rotor such that the brush is coaxial with the first shaft. Thus, the axially extending shaft on the brush is actually what the rotor rotates on.

A cover is provided for the bottom opening of the housing. It has a hole through which the brush bristles extend. The circular base plate of the brush has a diameter larger than the hole in the cover so that a rim around the margins of the hole retains the brush in the housing. Moreover, by holding the brush against slipping axially off of the shaft with the cover, all gears and pinions and the turbine rotor are held in place by the brush itself. Thus, there is no necessity for using set screws or keys or through-pins to keep parts in place as in prior art water-powered brushes.

The housing cover is fastened to the housing without the use of separate fasteners. Latch prongs are molded on the perimetral wall of the housing. They are bendable and resilient similar to flat springs which have a hook formed at their free ends. The cover has holes in positions corresponding to the positions of the latch prongs on the housing. The prongs are deflected inwardly when the cover is fitted onto the housing and finally the hooks slide through the edges of the holes and deflect outwardly to latch the cover on the housing. Thus, a snap-on cover maintains the brush in assembled condition.

The brush has a chamber for storing cleaning fluid which can be entrained in the water stream under the control of a finger operated valve.

How the above-mentioned features and other objectives and advantages of the new brush design are achieved will appear from the following more detailed description of a preferred embodiment of the brush in which reference will be made to the accompanying drawing sheet.

DESCRIPTION OF A PREFERRED EMBODIMENT

Figure 2:
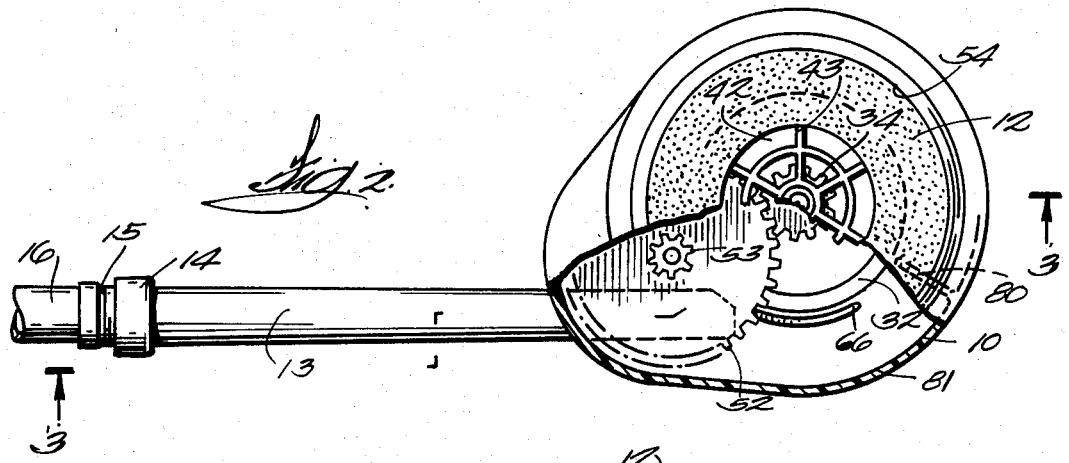
FIG. 2 is a bottom plan view of the brush with the bottom cover partially broken away and with internal parts broken away to better illustrate the construction.
Figure 1:
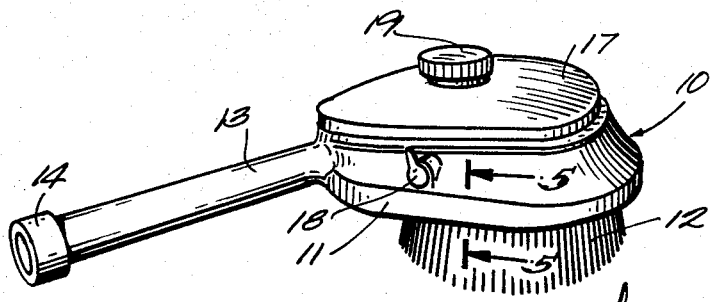
FIG. 1 is a perspective view of the new water-powered brush in its upright position.

FIG. 1 is an exterior view of the water-powered brush. It comprises a shell-like housing, generally indicated by the reference numeral 10. The housing has a bottom opening which is closed by a cover designated generally the the numeral 11. A circular array of bristles 12 of the rotary brush extend through a suitable opening in cover 11. The cover is coupled to housing 10 with snap-acting latch means as will be described in detail later. A conduit 13 is molded integrally with the housing for delivering pressurized water to the tubine rotor from which power for driving the brush rotationally is derived. Conduit 13 also serves as a handle for manipulating the brush while washing an automobile or other object. The handle has an enlarged diameter portion 14 which is internally threaded for receiving the male thread of a hose coupling 15 as shown in FIG. 2 where a fragment of a hose is marked 16.

The brush in FIG. 1 also has an outermost wall 17 which defines a chamber for storing a cleaning fluid that may be metered into the water stream with a valve whose control handle is labeled 18. A screw-on cap 19 is provided for admitting a quantity of cleaning fluid into the chamber.

Figure 3:
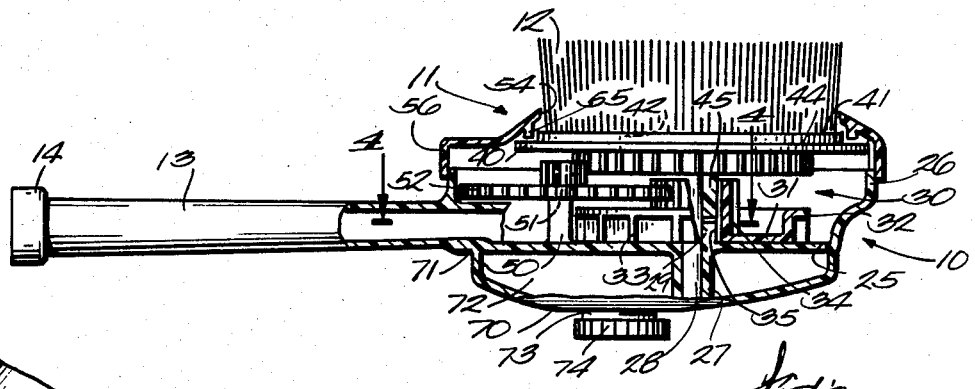
FIG. 3 is a vertical section of the brush taken on a line corresponding with the irregular line 3—3 in FIG. 2, the brush being inverted in comparison with FIG. 1.

Attention is now invited to FIG. 3. Here one may see that the main housing 10 of the brush is molded plastic in a single piece with handle 13 and comprises a nominally top wall 25 and an integral perimetral wall 26. The top wall 25 and perimetral wall 26 define a housing whose bottom is open until the last step in the brush assembly procedure is taken, which is to latch on cover 11. Top wall 25 has a cylindrical projection 27 molded integrally with it. There is a first axially extending shaft 28, preferably metal, fixed as an insert in projection 27 during the housing molding process. On the inside face of top wall 25 a boss 29 is molded and half of it is shown in section. The turbine rotor is generally designated by the numeral 30. It is basically a disk 31 with a radially extending rim 32 about which there are a plurality of circumferentially spaced apart turbine blades 33. A pinion 34 is molded integrally and concentrically to turbine rotor disk 31. Note that the bore 35 of pinion 34 has a diameter substantially greater than the outside diameter of cylindrical boss 29 so the pinion on the rotor fits loosely or with a substantial amount of clearance around boss 29. In other words, as will be shown, the rotor is not journaled for rotation on boss 29 but is otherwise journaled for rotation.

The rotatable brush assembly comprises a base member in the form of a disk or flat ring 40 on which there is an integrally molded circular axially extending guide rim 41. As can be seen in FIG. 2, base member disk 40 has a central hole 42 and radially extending spokes 43. As can be seen in FIG. 3, a gear 44 is molded integrally with the base member 40 of the brush. The spokes 43 extend radially far enough to join with the inside diameter of gear 44. A cylindrical shaft 45 extends axially from the center of the spokes. Cylindrical shaft 45 has a bore which permits it to be slipped on and journaled on first stationary metal shaft 28. The end of cylindrical shaft 45 bears on the top surface of boss 29 to limit the distance that the brush assembly and its gear 44 can move inwardly of the housing. The outside diameter of cylindrical shaft 45 is complementary to the inside diameter of pinion 34 which is integral with rotor 30. Thus, rotor 30 is journaled for rotation on cylindrical shaft 45 which is part of the brush assembly. To summarize, gear 44 and the brush assembly to which it is attached is journaled for rotation on fixed metal shaft 28 and is concentric with rotor 30. Rotor 30, on the other hand, is journaled for rotation, by way of the bore 35 in pinion 34, on the brush or, in reality, the cylindrical shaft 45 which extends from the brush base member 40.

The description thus far is explanatory of how the brush and rotor are mounted for rotation about a common axis. The manner in which driving force is transmitted from turbine rotor 30 to gear 44 on the brush assembly will now be described. There is a second boss 50 extending axially from and molded integrally with top wall 25 of the housing. This boss has a reduced diameter extension 51 molded onto it. Extension 51 constitutes a second shaft whose axis is parallel to first shaft 28. Where the second shaft 51 joins the larger diameter boss 50, a shoulder is created. A gear 52 and pinion 53 are molded integrally and have a common bore for fitting onto second shaft 51 to thereby journal the gear and pinion for joint rotation. Gear 52 meshes with smaller diameter pinion 34 on the turbine rotor 30 and, thus, there is a speed reduction in the larger diameter gear 52. Pinion 53 on gear 52 meshes with gear 44 on the brush assembly. The gear ratio is such that the brush turns at a much lower speed than turbine rotor 30.

The brush, gear train and rotor assembly are secured in housing 10 with only one part, namely a retainer member or cover which is shown in section in FIG. 3 and is designated generally by the numeral 11. The retainer member is much like a ring that has a central hole in its bottom through which the bristles 12 of the rotary brush etend. As can be seen in FIG. 3, the retainer member has an annular rib 55 which is in interfering relation with the base member of ring 40 to thereby constrain the brush to remain on fixed first shaft 28. Substantial end play is allowed throughout the gear train so no substantial friction is generated with the brush disposed in any attitude, especially since there is water between the moving parts when the brush is in use. As indicated earlier, because the brush and its main gear 44 is blocked against slipping axially off of stationary first shaft 28, all of the other moving parts are blocked from separating from the shafts.

The cover or retainer member 11 is essentially a shell that has an axially extending rim 56 which allows the member to be slipped over the perimetral wall 26 of the gear, turbine rotor and brush housing. A plurality of prongs 57 extend from the edge of perimetral wall 26 of the housing. Since the housing and retainer cover are molded from ABS resin, by way of example and not limitation, the latch prongs 57 are resilient and bendable and somewhat like flat springs. The prongs terminate in hooked ends 58. When the retainer cover 11 is pressed manually onto wall 26 of the housing, the hooked ends slide along the inside of wall 26 and are flexed inwardly until the hooked ends 58 reach correspondingly shaped holes 59 in rim 56 of the cover whereupon the hooked ends spring into the holes and secure the cover to the housing 10.

Figure 5:
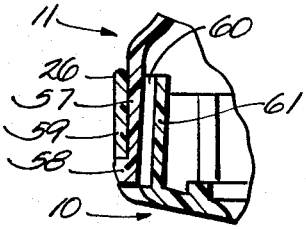
FIG. 5 is a fragmentary view taken on a line corresponding with 5—5 in FIG. 1 and showing the manner in which a cover is latched onto the brush housing.

The latch prongs 57 fit through sockets 60 which are defined by side walls and an inside wall 61 which is shown in section in FIG. 5. The walls of these sockets serve a double purpose in that they provide guides for the assembler for facilitating registration of the latch prongs with the holes in which their hooks latch. In addition, they prevent water from leaking out of the housing through the holes 59 for the latch prong hooks 58. Water that is spent after it impels the turbine rotor fills the housing and ultimately flows out through the center hole 42 of the brush base and along the periphery of the circular array of brush bristles.

Figure 4:
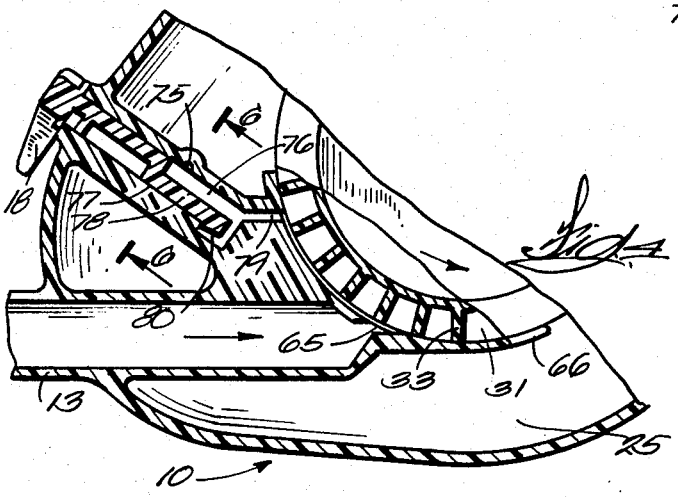
FIG. 4 is a partial transverse section taken on a line corresponding with 4—4 in FIG. 3.

As shown in FIG. 4, the water input conduit 13 is molded integrally with housing 10 and terminates in an orifice 65 through which the water jet is projected for acting on the blades 33 of the turbine rotor to impel it rotationally. The conduit 33 is formed unitarily with housing 10 and with a barrier wall 66 which projects from nominally top wall 25 of the housing. Barrier wall 66 has the configuration of a segment of a circle and is concentric with but slightly spaced from the tips of rotor blades 33 so the rotor can rotate without frictional drag. Moreover, the barrier wall assures that all of the water jet projected from orifice 65 will do useful work on the turbine blades without undue turbulence.

Figure 6:
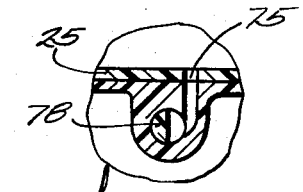
FIG. 6 is a transverse section taken through a cleaning fluid control valve on a line corresponding with 6—6 in FIG. 4.

Referring again to FIG. 3, a cap 70 is adhered around its edges 71 to what is nominally the top surface of housing wall 25. Cap 70 defines a chamber 72 which can be filled with a liquid cleaning solvent through the mouth of an integral tube 73 which is threaded to receive a closure cap 74. As shown in FIGS. 6 and 4, the top housing wall 25 is provided with a small hole 75 which leads to a valve cylinder 76. There is what may be termed essentially a valve plug 77 in the cylinder. FIG. 6 shows how one end 78 of the valve plug is semicircular in cross section so that when the plug is rotated this part can turn onto hole 75 so as to regulate or shut off flow of cleaning solvent to the interior of the brush housing. Cylinder 76 terminates in a small orifice 79 which extends into barrier wall 66 so that a pulse or small quantity of cleaning solvent can be fed directly to the turbine blades to be entrained in the jet stream and distributed or mixed in the water before it emerges through the brush. The valve stem is preferably made of a more flexible plastic material than is the housing so it can be pushed into the cylinder and retained therein by the snap action of the hook end 80 of the valve stem. The valve stem is turned from outside of the brush by means of knob 18.

One of the novel features of the new water-powered brush is that the brush base, the integral gear 44 thereon, the unitary gear and pinion 52 and 55, and the turbine rotor 30 are all molded of polycarbonate resin, particularly the polyester known by the trademark "Valox". This is a high strength resin and contributes to the light weight and toughness of the brush assembly, which weight would be greater if metal parts were used as is common in prior art water-powered brushes.

Housing 10 and the solvent chamber wall 70 are all molded of ABS resin although other resins of comparable characteristics could be used.

As can be seen in FIG. 2, a radially inwardly directed vane 80 is molded inside of housing 10. It was found that within this vane causing some water to be trapped in the region 81 outside of the turbine wheel, the rotor rotated unduly fast. Trapping water imposes some drag on the turbine rotor which was found to bring it down to an acceptable rotational speed.

To orientate the reader to the actual size of a commercial embodiment of the new water-powered brush, one can use for reference the fact that the diameter of the large gear 44 on the brush assembly is about 4.75 inches. The brush turns at 142 rpm under the normal residential water pressure of about 40 lbs. It takes a counter force of about 23 lbs. to stop rotation and since a user would normally exert no more than 12 lbs. of force in normal use, stopping of brush rotation is highly improbable.

Although a preferred embodiment of the new brush has been described in detail, such description is intended to be illustrative rather than limiting, for the invention may be variously modified and is to be limited only by interpretation of the claims which follow.

We claim:

1. A water-powered brush comprising:

a housing having a generally planar nominally top wall and a perimetral wall defining the boundaries of the top wall and extending from the top wall to define the boundary of a bottom opening in the housing, a curved barrier wall having the configuration of a segment of a circle projecting from said top wall toward said bottom opening, a first boss projecting from said top wall toward said bottom opening and a first fixed shaft at the center of curvature of said barrier wall and extending from the boss such that the free end of the boss provides a bearing shoulder, a water supply conduit joined to said housing and terminating in an orifice in said barrier wall for projecting a jet of water generally tangentially to the curvature of the barrier wall, a turbine rotor comprised of a disk and a first pinion projecting integrally and coaxially from one side of the disk in the direction of said bottom opening, said disk and pinion having a coaxial bore of sufficient diameter to provide for fitting over said boss with substantial clearance, said disk having a plurality of circumferentially spaced apart peripheral turbine blades extending into proximity with said barrier wall for said jet to impel said rotor, a second boss located radially outwardly of said circular barrier wall and extending away from said top wall and a second shaft extending from said second boss in parallelism with said first shaft, a gear and a second pinion integral and coaxial with said gear and having a common bore for being jointly rotatable on the shaft extending from said second boss while bearing on said second boss with said gear meshing with said first pinion, brush means including a circular base member having a circular array of bristles extending from one side and a second gear on the opposite side and a cylindrical shaft extending axially from the center of the second gear, said cylindrical shaft having a bore for fitting in bearing relationship on said first stationary shaft and having an outside diameter for fitting into the bore of the pinion on said turbine rotor so the rotor is journaled for rotation on said cylindrical shaft while the gear on said base member is meshed with said second pinion to drive said brush means rotationally, and a retainer cover and means for coupling said cover to said housing to close its said bottom opening, said cover having a hole for said brush to extend through the rim of said hole underlying the margin of said circular base member to thereby retain said brush means on said first shaft whereupon said brush means is held in a position for preventing said gears, pinions and rotor from sliding off of their shafts.

2. The device according to claim 1 wherein said retainer cover has a boundary wall having an internal shape that is complementary to the external shape of said perimetral wall of the housing so said boundary wall fits snugly on said perimetral wall, and said means for coupling said cover to said housing comprises a plurality of resilient latch elements projecting from said perimetral wall and said elements having a hook portion on their ends, said cover boundary wall having sockets located in correspondence with said latch elements and said sockets having entrances inside of said boundary wall and a hole in the member at the end of each socket, whereby said latch elements pass through said sockets and the hooks pass through said hooks to latch onto said boundary wall by engaging the margins of the holes.

3. The device according to any one of claims 1 or 2 including a member sealingly engaged with said housing top wall on the side opposite of said perimetral wall for defining a chamber for containing cleaning fluid, a passageway having an input port for cleaning fluid presented to said chamber and terminating in an output orifice in said curved barrier wall next to said brush.

4. The device according to claim 3 including a throttle valve in said passageway for regulating the flow rate of said cleaning fluid.

5. The device according to claim 1 wherein said gears and pinions are composed of polycarbonate resin.

* * * * *

UNITED STATES PATENT AND TRADEMARK OFFICE

CERTIFICATE OF CORRECTION

PATENT NO. : 4,513,466

DATED : April 30, 1985

INVENTOR(S) : David P. Keddie and Richard J. Shaw

It is certified that error appears in the above-identified patent and that said Letters Patent are hereby corrected as shown below:

Column 6, line 52, change "hooks" (second occurrence) to ---holes---.

Signed and Sealed this

*Twelfth* Day of *November 1985*

[SEAL]

*Attest:*

DONALD J. QUIGG

*Attesting Officer*

*Commissioner of Patents and Trademarks*